United States Patent [19]

Arens

[11] Patent Number: 4,493,174

[45] Date of Patent: Jan. 15, 1985

[54] DISMOUNTABLE ROOM PARTITION

[75] Inventor: Robert A. Arens, Candia, N.H.

[73] Assignee: Artafax Systems Limited, Inc., Manchester, N.H.

[21] Appl. No.: 385,681

[22] Filed: Jun. 7, 1982

[51] Int. Cl.[3] ..... F04H 1/00

[52] U.S. Cl. ..... 52/243; 52/221; 52/727; 160/351

[58] Field of Search ..... 52/239, 243, DIG. 13, 52/727; 160/135, 351; 428/100

[56] References Cited

U.S. PATENT DOCUMENTS

| | | | |
|---|---|---|---|
| 3,513,606 | 5/1970 | Jones | 52/243 X |
| 3,571,999 | 3/1971 | Downing | 52/483 |
| 3,856,981 | 12/1974 | Boundy | 174/48 |
| 3,987,838 | 10/1976 | LaGue et al. | 160/351 |
| 4,020,604 | 5/1977 | Legler et al. | 52/65 |
| 4,028,855 | 6/1977 | Prewer | 52/DIG. 13 X |
| 4,047,337 | 9/1977 | Bergstrom | 52/71 |
| 4,068,700 | 1/1978 | Legler | 160/351 |
| 4,090,335 | 5/1978 | Curatolo | 52/DIG. 13 X |
| 4,118,903 | 10/1978 | Coulthard | 52/36 |
| 4,134,564 | 1/1979 | Hanna | 248/243 |
| 4,250,676 | 2/1981 | Presby | 52/222 |
| 4,373,570 | 2/1983 | Nussdorf et al. | 160/352 |

FOREIGN PATENT DOCUMENTS

| | | | |
|---|---|---|---|
| 1031531 | 10/1975 | Canada | 20/22.1 |
| 1032723 | 5/1976 | Canada | 20/22.1 |
| 7300610 | 12/1974 | Sweden | 52/DIG. 13 |
| 632034 | 9/1982 | Switzerland . | |

*Primary Examiner*—Carl D. Friedman

*Attorney, Agent, or Firm*—Hayes, Davis & Soloway

[57] ABSTRACT

A knock-down room divider construction comprises a series of separate posts and panels which are mutually releasably engageable. Each post comprises a rigid core member covered on its outer surface with a fastening fabric which is complementary to a second fastening fabric on the vertical edge of a panel section. By having the panels and supporting posts as separate units, a lighter construction is possible and there is a greater flexibility in geometry and arrangement of the room partition.

17 Claims, 6 Drawing Figures

DISMOUNTABLE ROOM PARTITION

INTRODUCTION

This invention is concerned with a dismountable or temporary room partition or divider as may be used to make booths for a trade show, to divide work stations in an office or to provide temporary surfaces for displays such as an art exhibition. In brief compass this invention provides a room divider consisting of the basic elements of a post and panel several of which are in combination to set off or define room space as desired. The post and panel are mutually engageable along elongated edges thereof. When used in series a post in the central portion of the series will support two or more panels. The panel comprises a major surface which may be curvilinear or flat and covered on its intended vertical edge with a first fastening fabric. The post consists of an elongated member covered on its outer surface with a second fastening fabric complementary to the first fastening fabric and mutually releasably engageable therewith. This permits the panel to be temporarily adhered to the post and then to be readily detached to take apart the partition when desired.

PRIOR ART

The most pertinent references known to the inventor at present are Canadian Pat. No. 1,031,531 issued May 23, 1978 in the name of Torsten Bergstrom and assigned to Formfac International AB, Sweden and Canadian Pat. No. 1,032,723 issued June 13, 1978 in the name of George Legler and assigned to Precision Manufacturing Inc.—Fabrication Precision Inc. of Canada.

These patents disclose room partition panels held togehter at their ends by complementary fastening tapes on each vertical edge. However, the end post-vertical fastening surfaces are integral with the panels and not separate as in the present invention. The panels are necessarily therefor of heavier, more expensive construction and as one end of a panel must be provided with a male fastening fabric and the other with a female fastening fabric a great deal of flexibility is lost in the employment of the panels.

DRAWINGS

The single sheet of drawing consisting of four figures attached hereto illustrate the major aspects of the present invention.

DESCRIPTION

Figure 1:
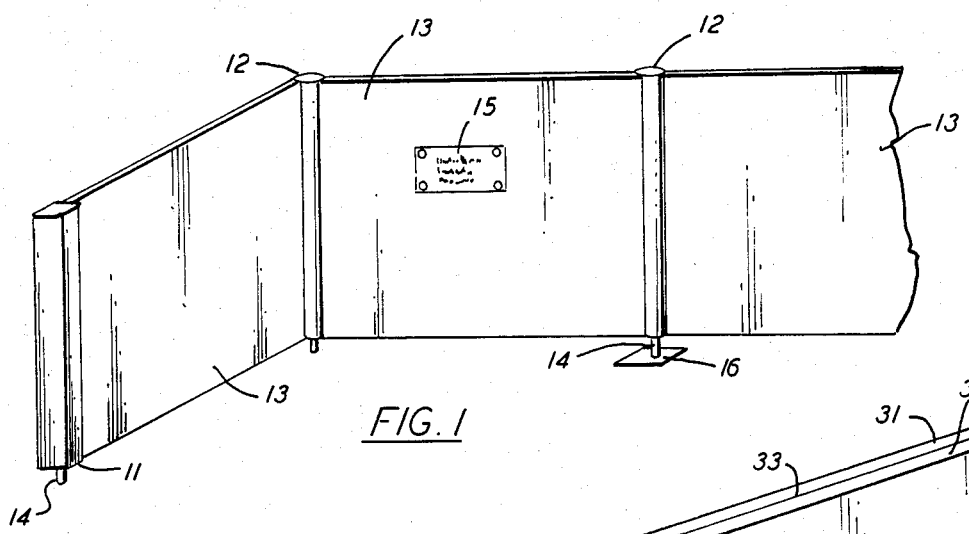
FIG. 1 illustrates a series of panels and posts of this invention as may be used to define a corner within a larger open room area.
Figure 5:
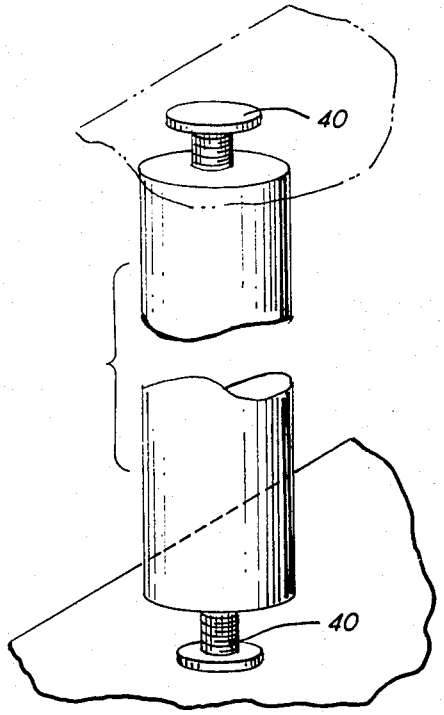
FIG. 5 is an illustration of another form of post member that can be used in the practice of this invention.

With reference to FIG. 1 illustrated is a series of panels 13 supported by a series of posts 11 and 12. While the posts are preferable circular so as to permit unlimited geometry in the placement of the panels thereabout as is shown by post 12 other shapes can be used such as hexagonal or the square shape shown for post 11. These posts can terminate as of at with means for spacing the posts from the wall or floor although they can, of course, rest directly on the floor. If desired, the posts can have a plate or like member 16 affixed to the bottom to be self-standing. Alternately, the posts may be fitted top and bottom with bolts 40, springs or the like for pressure fitting between the floor and ceiling as shown in FIG. 5.

Panels 13 can be of any desired construction. If only visual blocking is required, then they can be of a lightweight foam plastic. They can have more substance by being laminated such as to be able to support the attachment of surface mountings thereon such as is illustrated at 15. Quite often it is desired that the panels should be of sound-deadening material such as an epoxy fiberglass composite or laminate. The construction of such panels is known and any one of the several types commercially available can be used in the practice of this invention. What is required is that the elongated edge of the panel must be capable of accepting a fastening fabric which mates in a releasable engageable manner with the complementary fabric on the surfaces of the posts 11 and 12.

Figure 2:
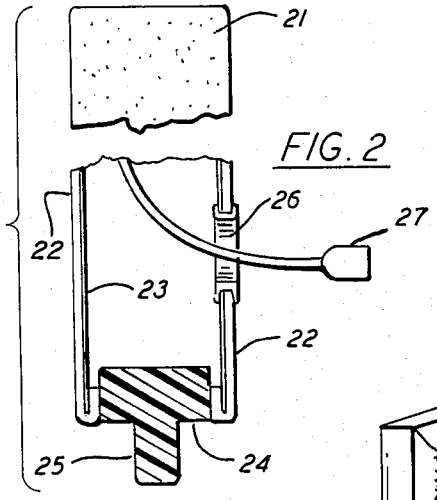
FIG. 2 is an illustration, in part broken away, of one form of post member that can be used in the practice of this invention.

With reference to FIG. 2 a post covered with a fabric is indicated generally at 21. In the broken away portion of the figure can be seen the fabric covering 22 disposed about the outer surface of a core member 23. The core member may be of any suitable rigid material such as extruded aluminum or vinyl pipe. Wood would also be satisfactory. The fabric is preferably an elastic fabric in the form of a sleeve which is drawn tightly over the core member 23 with sufficient length being left so as to be able to turn the ends into the inside of the core member as is illustrated. While fabric 22 can be adhesively secured to the core member, normally this is not necessary if the fabric is stretched tightly over the core member and secured at the ends.

One way of securing the fabric at the ends of the core member is to insert a plug 24 with the force fit so as to securely hold the turned in ends of fabric sleeve 22. Optimally, plug 24 can be glued in place or held with a mechanical fastener. Fabric sleeve 22 can be formed in any suitable manner. It can be knit as such as from a double-knit synthetic felt fabric in the manner of making a sock or it can be stitched from a flat sheet of nylon pile or the like.

Fabric 22 may also comprise one of a pair of mutually engageable and releasable fastening fabrics such as those identified as Velcro fabrics.

Plug 24 can have an extension of 25 to space the post from the floor. This can be integral with the plug or can be a screwed on attachment.

Figure 6:
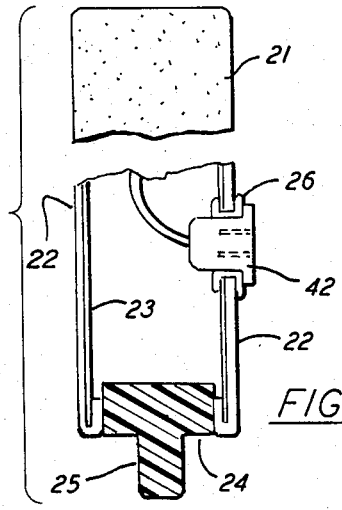
FIG. 6 is an illustration similar to FIG. 2 of still another form of post member in accordance with this invention.

If the core 23 is hollow, it can also be used to supply services such as wiring. As illustrated, an electric line 27 is carried through the core and exits at an open 26 provided in the wall 23 of the core. Opening 26 could be provided with a suitable receptacle 42 as shown in FIG. 6.

Figure 3:
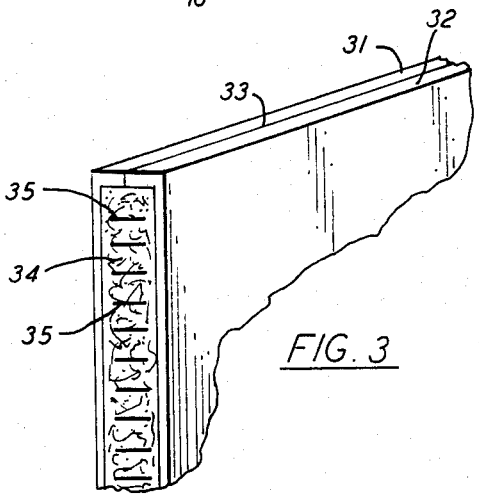
FIG. 3 is an illustration of one form of a panel member which can be used in the practice of this invention.

FIG. 3 illustrates a panel construction which is preferred because of its simplicity of manufacture. It consists of two sheets of suitable material 31 and 32, the line of separation between the two which is visible to the eyes being shown at 33. On the elongated edge of the panel usually the one intended to be vertically placed, there is attached a strip of fabric 34 as by means of staples 35 or by an adhesive. Fabric 34 is of one of a pair of mutually engageable and releasable fastening fabrics, e.g. a so-called Velcro fabric.

Figure 4:
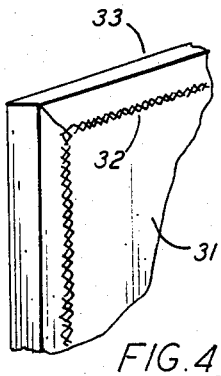
FIG. 4 is a view of a portion of a sheet used to form the panel member of FIG. 3.

One of the sheets 31 of FIG. 3 is shown in FIG. 4 without the fabric 34 being attached thereto. Usually the outer surfaces of sheets 31 and 32 will be covered with a fabric for the sake of appearance as well as perhaps for structural strength. Such a fabric is shown at 33. It has been found that it is easier from a manufacturing standpoint to use two sheets as is shown in FIG. 3 to support the fabric 33 and to turn the fabric around the edge of the sheet as is shown at 32 and terminate it there, fastening it to the sheet by means of a suitable adhesive or tape. This is easier than attempting to cover a single panel and to attempt to do a smooth job of concealing the fabric edges.

Fabrics 22 and 34 are complementary and will mutually engage each other. Thus it can be seen that all that is necessary in order to put the posts and the panels in place is to bring the two into firm contact allowing the fabrics to engage. With the Velcro-type of fastener, one of the fabrics will comprise the looped female portion of the fabric and the other will comprise the hooked male portion. Alternatively, a single Velcro-type fabric of the "male" or "hook" type can be used as fabric strip 34, for engaging with fabric 22 formed of a pile or felt fabric.

The panels of course may be placed in any position on the post so that their upswing from the floor can be readily set and/or permitting one panel to be secured at a height different from its neighbors for aesthetic reasons. While full panels are shown, the panels can be sectioned horizontally, for example, with two or more panels being required to make any one wall section.

It is also within the scope of the present invention to connect panel 13 to a wall, bookcase or a piece of furniture, the latter being provided with a complementary fastening fabric type for engaging with fabric 34. Also, if desired, fixtures such as picture hooks, shelves or the like may be provided with a complementary fastening fabric tape for engaging with fabric 22 or with fabric 34 so as to permit mounting of the fixtures on a panel or post. Still other changes will be obvious to one skilled in the art.

What is claimed is:

1. A divider construction comprising a post and a panel mutually releasably engageable along elongated edges thereof;

said panel comprising a major surface having an elongated edge covered at least in part with a first hooked fiber fabric, and said post comprising a rigid elongated core member comprising a hollow tube, said member firmly covered on its outer surface with a looped fiber fabric complementary to said hooked fiber fabric and mutually releasably engageable therewith, said looped fiber fabric comprising an elastic pile or felt fabric sleeve pulled over said core and firmly affixed to the ends of said core by means of the ends of said sleeve being turned into the ends of the core and secured with end plugs.

2. The construction of claim 1 wherein said panel is curved and is of a lightweight foamed plastic.

3. The construction of claim 1 wherein said panel is flat and is of a sound insulating material.

4. The construction of claim 3 wherein said panel is fabric covered and is capable of accepting surface mountings thereon.

5. The construction of claim 1 wherein said post and panel are part of a series, the panels of which are to be placed vertically and each of which panels is covered at least in part with said hooked fiber fabric along a major portion of the length of both of the intended vertical edges thereof.

6. The construction of claim 1 wherein said post is square in cross section.

7. The construction of claim 1 wherein said post is circular in cross section.

8. The construction of claim 1 wherein said looped fiber fabric comprises a double knit synthetic felt fabric, and said hooked fiber fabric comprises a Velcro-type hooked fibric.

9. The construction of claim 1, wherein said end plugs include means for positioning said core relative to a floor.

10. The construction of claim 1 wherein said panel has extended flat fabric covered surfaces on either sides and consists of two aligned sheets affixed one to the other on one of the major surfaces of each sheet, the fabric covering on each of said sheets extending around the edges thereof and terminating, said hooked fiber fabric affixed on at least one edge of said panel and covering at least in part the line of separation between said sheets.

11. The support of claim 1, wherein said sleeve comprises a hooked fiber fabric.

12. A support comprising an elongated member comprising a hollow tube, said member tightly covered with a sleeve of an elastic pile or felt fabric affixed at the end of said elongated member by means of end plugs engaging and holding the ends of said sleeve turned into the ends of said member, said pile or felt fabric being one member of a pair of complementary fabrics mutually releasably engageable.

13. A support according to claim 12, wherein said hollow tube is square in cross-section.

14. A support according to claim 12, wherein said hollow tube is circular in cross-section.

15. The support of claim 12, wherein said sleeve comprises a looped fiber fabric.

16. The construction of claim 1, wherein said end plugs are force fitted in the ends of said core.

17. The support of claim 12, wherein said end plugs are force fitted in the ends of said hollow tube.

* * * * *